US006886699B2

(12) United States Patent
Johnson et al.

(10) Patent No.: US 6,886,699 B2
(45) Date of Patent: May 3, 2005

(54) MERCHANDISING SYSTEM

(75) Inventors: Allen E. Johnson, Hartford, WI (US); M. Scott Bryson, Brookfield, WI (US); Gary Michael Richter, Waukesha, WI (US); Terrence G. Berglund, Hales Corners, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 10/272,527

(22) Filed: Oct. 15, 2002

(65) Prior Publication Data

US 2003/0085187 A1 May 8, 2003

Related U.S. Application Data

(60) Provisional application No. 60/329,656, filed on Oct. 15, 2001.

(51) Int. Cl.[7] ..... A47F 7/00

(52) U.S. Cl. ..... 211/59.3; 211/184; 211/175; 108/61

(58) Field of Search ..... 211/175, 59.3, 211/59.2, 184; 312/61, 71, 45; 108/60, 61

(56) References Cited

U.S. PATENT DOCUMENTS

| | | | | | |
|---|---|---|---|---|---|
| 2,652,154 | A | * | 9/1953 | Stevens | 211/59.3 |
| 4,685,574 | A | | 8/1987 | Young et al. | |
| 4,724,968 | A | * | 2/1988 | Wombacher | 211/59.3 |
| 4,762,236 | A | | 8/1988 | Jackle, III et al. | |
| 4,830,201 | A | | 5/1989 | Breslow | |
| 4,901,869 | A | * | 2/1990 | Hawkinson et al. | 211/59.3 |
| 5,069,349 | A | | 12/1991 | Wear et al. | |
| 5,097,962 | A | * | 3/1992 | Eklof et al. | 211/59.2 |
| 5,199,584 | A | | 4/1993 | Fowler et al. | |
| 5,490,600 | A | | 2/1996 | Bustos | |
| 5,542,552 | A | * | 8/1996 | Yablans et al. | 211/59.3 |
| 5,577,623 | A | | 11/1996 | Bustos | |
| 5,634,564 | A | * | 6/1997 | Spamer et al. | 211/59.3 |
| 5,638,963 | A | | 6/1997 | Finnelly et al. | |
| 5,685,664 | A | * | 11/1997 | Parham et al. | 403/393 |
| 5,788,091 | A | * | 8/1998 | Robertson et al. | 211/59.2 |
| 5,839,588 | A | * | 11/1998 | Hawkinson | 211/59.3 |
| 6,041,720 | A | | 3/2000 | Hardy | |
| 6,105,791 | A | * | 8/2000 | Chalson et al. | 211/59.3 |
| 6,129,218 | A | | 10/2000 | Henry et al. | |
| 6,168,032 | B1 | | 1/2001 | Merl | |
| 6,227,385 | B1 | * | 5/2001 | Nickerson | 211/59.3 |
| 6,311,852 | B1 | | 11/2001 | Ireland | |
| 6,409,028 | B2 | * | 6/2002 | Nickerson | 211/59.3 |
| 6,571,498 | B1 | | 6/2003 | Cyrluk | |
| 6,585,120 | B2 | * | 7/2003 | Robertson | 211/59.2 |
| 6,622,874 | B1 | * | 9/2003 | Hawkinson | 211/59.3 |
| 2002/0170866 | A1 | * | 11/2002 | Johnson et al. | 211/59.3 |

* cited by examiner

*Primary Examiner*—Carl D. Friedman
*Assistant Examiner*—Jennifer E. Novosad
(74) *Attorney, Agent, or Firm*—Foley & Lardner LLP

(57) ABSTRACT

Systems and methods for merchandising product. A merchandising system includes a base having a first set of interfaces and a second set of interfaces, a first divider having a first engagement portion, and a second divider having a second engagement portion. The first engagement portion releasably couples to one of the interfaces of the first set of interfaces and the second engagement portion releasably couples to one of the interfaces of the second set of interfaces.

45 Claims, 7 Drawing Sheets

MERCHANDISING SYSTEM

CROSS-REFERENCE TO RELATED PATENT APPLICATIONS

The present application claims the benefit of priority as may be available under 35 U.S.C. §§119–21 from U.S. Provisional Patent Application No. 60/329,656 ("MERCHANDISING SYSTEM") filed Oct. 15, 2001 (incorporated by reference herein).

FIELD

The present invention relates to a merchandising system. The present invention more specifically relates to a merchandising system for a shelf or the like that provides for the selective adjustment of the width of a shelf division (or space division on a surface).

BACKGROUND

It is known to provide for a merchandising system providing a shelf divider for installation on a shelf of a shelving unit so that some type of product or merchandise may be stocked in a more orderly and organized manner. Such known shelf divider systems do not realize certain advantageous features (and/or combinations of features).

It would be advantageous to provide a merchandising system that would allow for independent adjustment of a division (which may be a display area, "facing," cell, compartment, etc.) without requiring adjustment of adjacent divisions within the system. It would also be advantageous to provide a merchandising system in which the size of one division could be enlarged or reduced without enlarging or reducing the size of an adjacent division. It would further be advantageous to provide a merchandising system with divisions that are conveniently and selectively adjustable in size or shape. It would further be advantageous to provide a merchandising system that provides for the selective movement of a divider to discrete locations. It would further be advantageous to provide a merchandising system that could be associated with or used with a product set having two or more sizes of product. It would further be advantageous to provide a merchandising system that provides for modularity in the construction and assembly of the merchandising system. It would further be advantageous to provide a merchandising system that could be installed on a shelf or shelving unit. It would further be advantageous to provide a merchandising system that would allow for a relatively simple connection between two divider panels.

It would be desirable to provide a merchandising system or the like of a type disclosed in the present application that includes any one or more of these or other advantageous features.

SUMMARY

The present invention relates to a merchandising system for articles. The merchandising system comprises a base having a first set of interfaces and a second set of interfaces, a first divider having a first engagement portion, and a second divider having a second engagement portion. The first engagement portion releasably couples to one of the interfaces of the first set of interfaces and the second engagement portion releasably couples to one of the interfaces of the second set of interfaces.

The present invention also relates to a merchandising system for articles. The merchandising system comprises a first member having a first connector, a second member having a second connector, and a third member having a first set of engagement portions and a second set of engagement portions. The first connector releasably couples to one of the engagement portions of the first set of engagement portions and the second connector releasably couples to one of the engagement portions of the second set of engagement portions.

The present invention further relates to a merchandising system comprising a first track including a horizontal surface. The horizontal surface has a first set of protrusions extending from the horizontal surface and a second set of protrusions extending from the horizontal surface. The merchandising system further comprises a second track including a vertical panel and a horizontal surface having a first engagement portion. The merchandising system further comprises a third track including a generally vertical panel and a generally horizontal surface, the horizontal surface having a second engagement portion. The first engagement portion releasably couples to the first set of protrusions and the second engagement member releasably couples to the second set of protrusions. The first track, the second track, and the third track provide a space for receiving articles.

DETAILED DESCRIPTION

Figure 1:
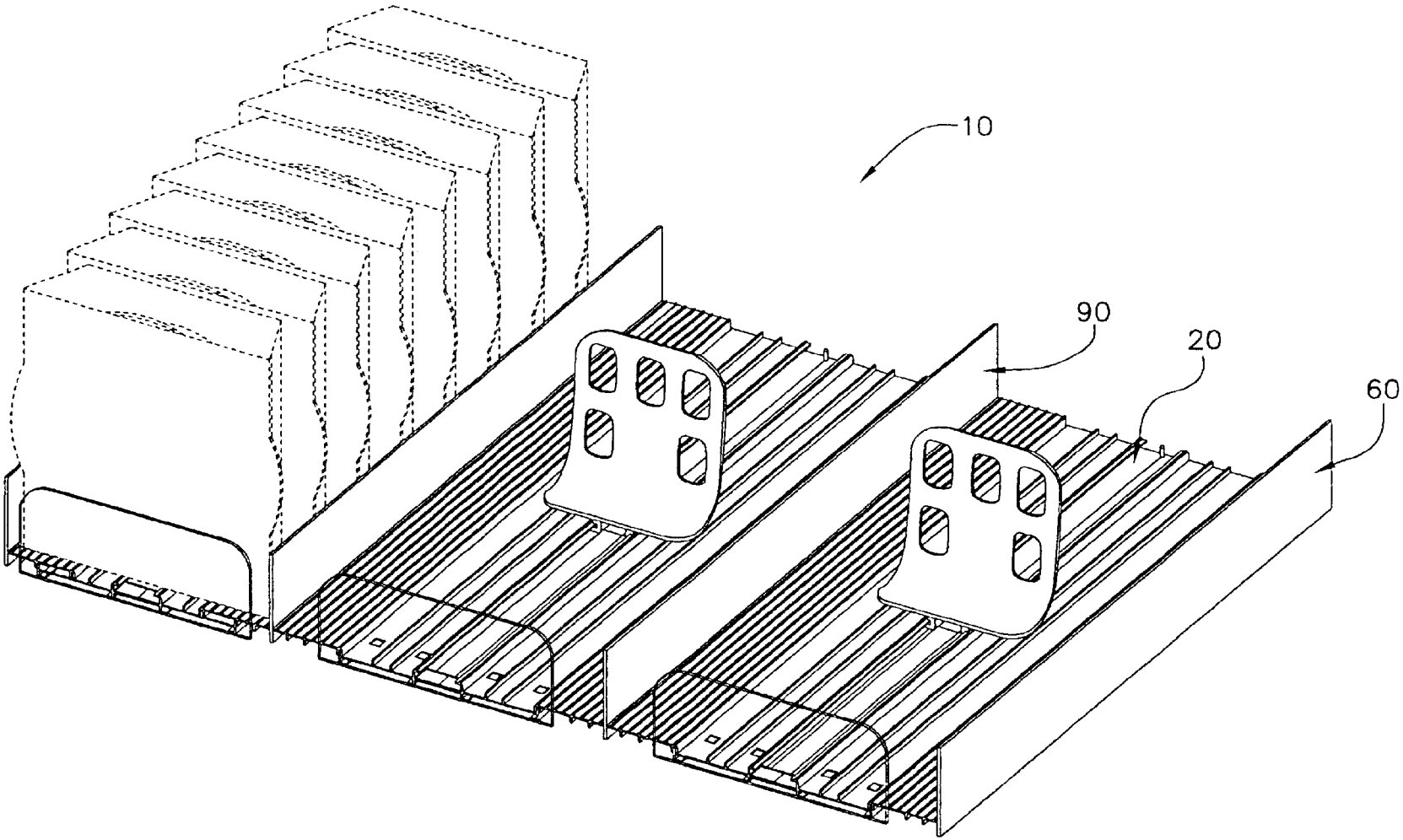
FIG. 1 is a front perspective view of a merchandising system according to an exemplary embodiment.

Exemplary embodiments of a merchandising system 10 as shown in FIGS. 1 to 7 are intended to provide for the display and storage of products in a simple and inexpensive system that can be adjusted to accommodate different sizes of products.

According to an exemplary embodiment of the present invention, a merchandising system (e.g., a shelf system, shelf divider system, product facing tray system, product self-facing and organization tray system, divider system, shelf tray system, pusher system, dispensing system, tray system, etc.) may comprise members (e.g., tracks, dividers, etc.) shown as center tracks 20, end tracks 60, and divider tracks 90. Merchandising system 10 may further comprise a pusher assembly 130 and a front plate 160. It should be noted at the outset that the tracks used in the present invention may be provided in various numbers and configurations, including different combinations of end tracks 60, center tracks 20, and divider tracks 90.

Figure 3:
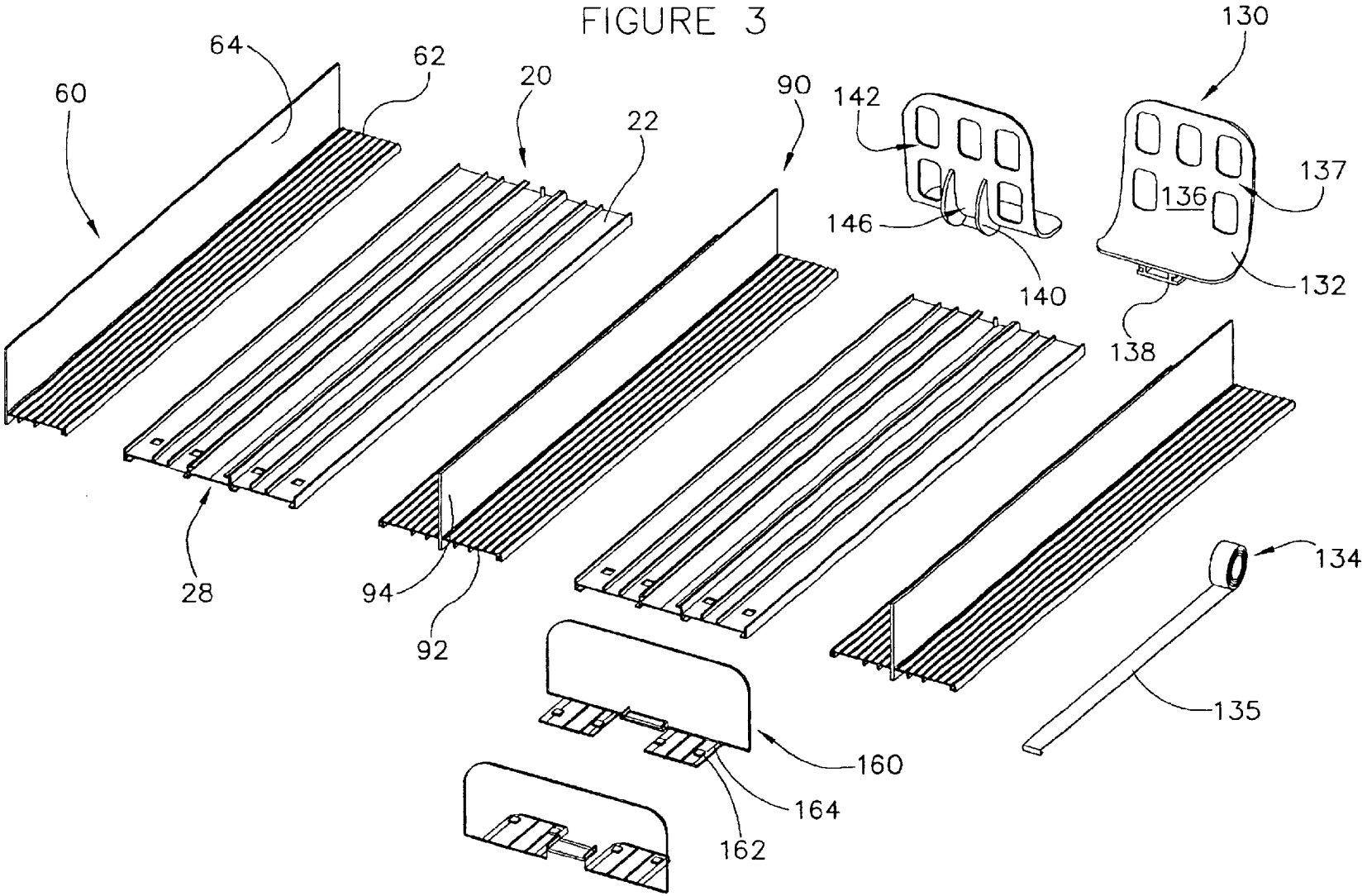
FIG. 3 is an exploded view of a merchandising system according to an exemplary embodiment.
Figure 4:
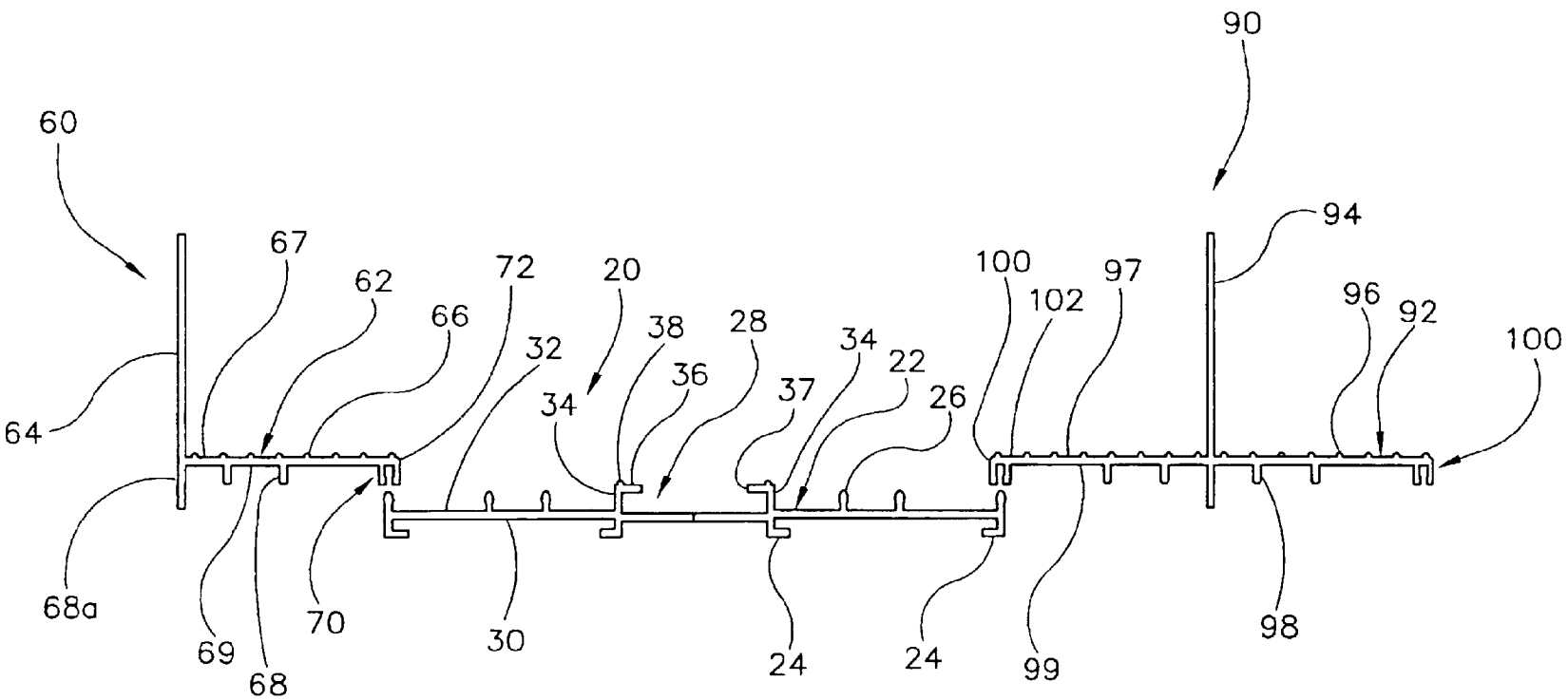
FIG. 4 is a front elevation view of a merchandising system according to an exemplary embodiment.
Figure 5:
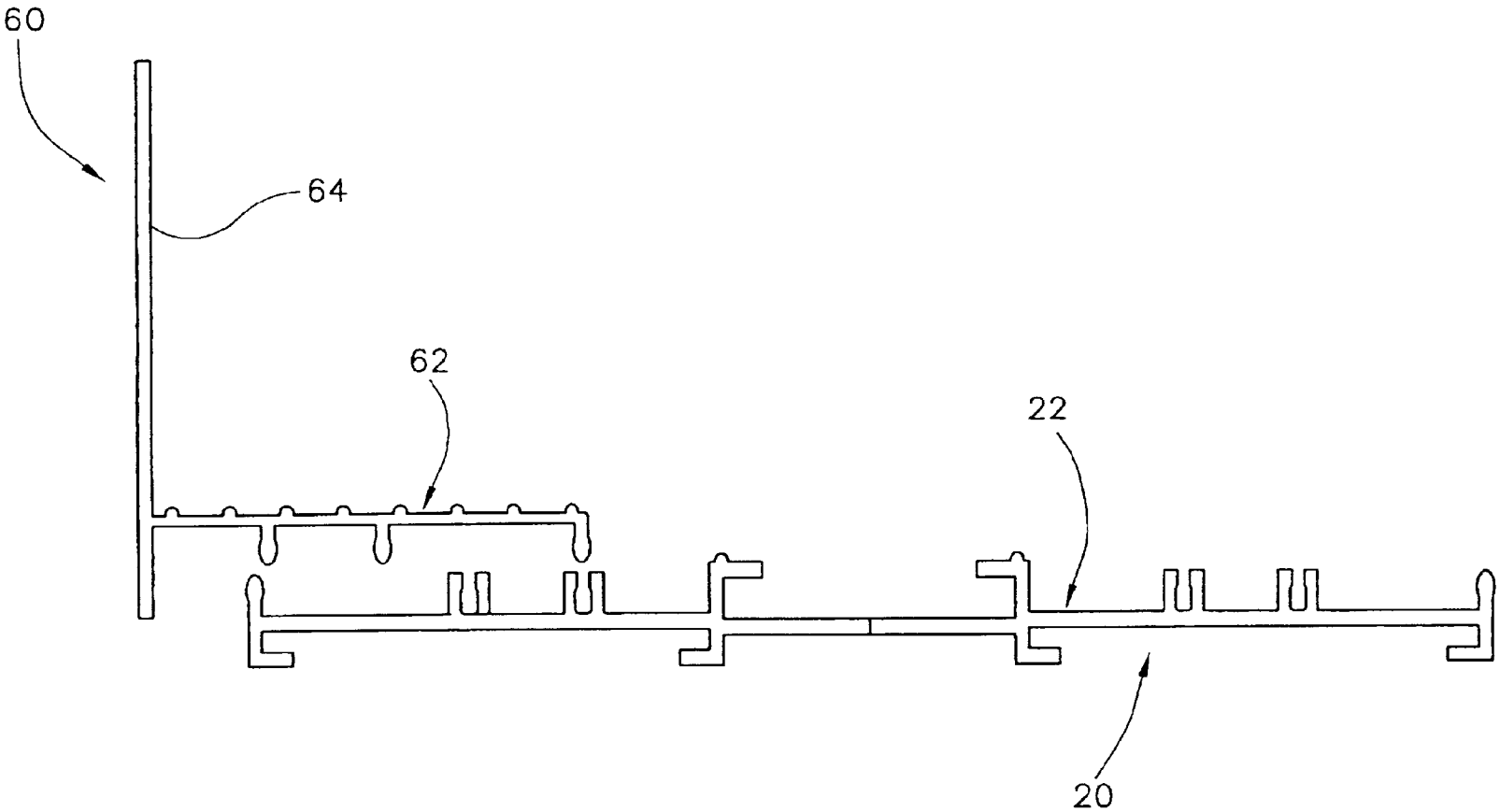
FIG. 5 is a front elevation view of a merchandising system according to an alternative embodiment.
Figure 6:
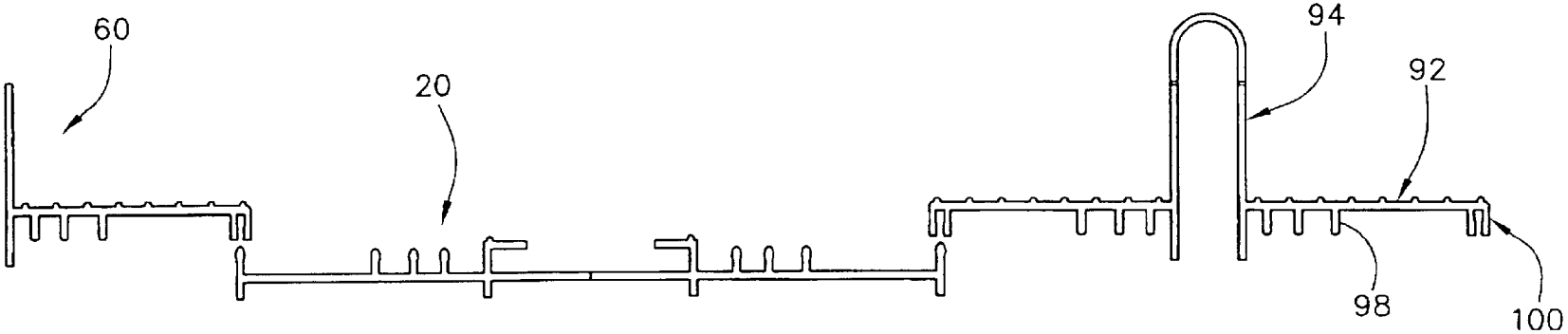
FIG. 6 is a front elevation view of a merchandising system according to an alternative embodiment.
Figure 7:
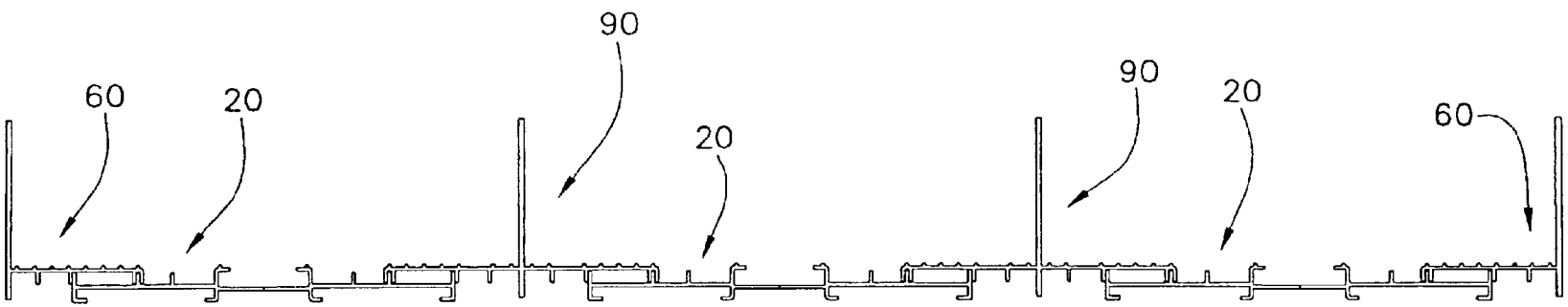
FIG. 7 is a front elevation view of a merchandising system according to an exemplary embodiment.

As shown in FIGS. 3 and 4, center track 20 (e.g., a central pusher track, connector, connecting member, extrusion, interface, base, panel, track, divider, shelf divider, etc.) may include a horizontal surface or portion 22, one or more protrusions 24, one or more interfaces 26, and a channel 28. Horizontal portion 22 is a substantially horizontal and generally flat member, panel, or surface having a longitudinal extension that generally extends along center track 20. Protrusions 24 may protrude from a bottom side 30 of horizontal portion 22 to support the horizontal portion 22 above an existing surface and/or to provide structural support, strength, stiffness, and rigidity for center track 20. In a particularly preferred embodiment, protrusions 24 protrude perpendicularly from bottom side 30 of horizontal portion 22 and extend the entire length of the horizontal member so that the longitudinal axis of each protrusion 24 is substantially parallel to the longitudinal axis of center track 20. In other embodiments, protrusions 24 may protrude at different angles from the bottom side 30, and may not run parallel to the longitudinal axis of center track 20. The size of protrusions 24, including the width and the distance protrusions 24 protrude from bottom side 30 of horizontal portion 22, may vary depending on the amount of structural support needed and the height a user of merchandising system 10 may desire to place products above the existing surface on which the system will be used, such as a shelf or other similar surface. In alternative embodiments, protrusions may be the same size and have the same orientation, protrusion angle, and extension direction, or they may differ in these respects. For example, some protrusions may be used to support the center track, and as a result may be longer or otherwise different than other protrusions that may be used for structural support, strength, stiffness, and rigidity. Supporting protrusions may also have a different orientation, protrusion angle, and extension direction than the strengthening protrusions.

In one exemplary embodiment, interfaces 26 (e.g., extensions, interfaces, protrusions, etc.) protrude from a top side 32 of horizontal portion 22. Interfaces 26 protrude perpendicularly from top side 32 and may extend the entire length of horizontal portion 22 so that the longitudinal axis of each interface 26 is substantially parallel to the longitudinal axis of center track 20. According to alternative embodiments, interfaces may protrude at different angles from the top side, and may not run parallel to the longitudinal axis of the center track. Additionally, each interface may not extend the entire length of the horizontal portion, but rather may intermittently protrude along the length of the horizontal portion, or may protrude for only a part of the length of the horizontal portion.

As shown in FIGS. 3 and 4, interfaces 26 are provided on horizontal portion 22 to allow center track 20 to couple (e.g., interface, engage, coact, etc.) with other tracks, such as an end track 60 and/or a divider track 90. To adjust the amount of space provided between each of the various tracks of merchandising system 10 (i.e., the space in which products will be placed), interfaces 26 may be provided at any desired distance away from the longitudinal axis of center track 20. The interfaces 26 may be numbered and positioned to accommodate a single product size, or interfaces 26 may be numbered and positioned to accommodate various product sizes. Additionally, interfaces 26 may be placed a specified distance away from the longitudinal axis of center track 20 in order to accommodate specific products, or specific product sets, the sizes of which may be known, or interfaces 26 may be intermittently placed at successively greater distances away from the longitudinal axis of center track 20 to accommodate a variety of product sizes. In a preferred embodiment, horizontal portion 22 is provided with eight interfaces 26, four on each side of the longitudinal axis of horizontal portion 22 (i.e., a first set and a second set). Alternatively, a number of variations in the number, spacing, sizing, and/or configuration of interfaces 26 may be used. In addition to facilitating the connection of tracks 20, 60 and 90, interfaces 26 may increase the stiffness, strength, and rigidity of center track 20. The size of interfaces 26, including the width and the distance interfaces 26 protrude away from top side 32 of horizontal portion 22, may vary depending on the amount of structural support needed and the height a user of merchandising system 10 may desire to place products above the existing surface on which the system will be used, such as a shelf or other similar surface.

As shown in FIGS. 3 and 4, center track 20 may also include a slot (e.g., channel, track, guide, pusher track, etc.) shown as channel 28 for receiving a pusher or other product biasing mechanism. In a preferred embodiment, channel 28 may include two side walls 34, two flanges 36, and ribs 38, all of which may extend the length of the center track 20. Each side wall 34 extends upwardly and perpendicularly from top side 32 of horizontal portion 22. A flange 36 is coupled to the distal end of each side wall 34 and extends toward the longitudinal axis of center track 20 (or towards the opposite flange 36). While the flanges 36 extend towards each other, they terminate before they intersect, leaving a space between the ends 37 of each of flanges 36. The combination of horizontal portion 22, side walls 34, and flanges 36 forms a rectangular enclosure in the cross-section of center track 20 that is partially open on the side formed by flanges 36. Channel 28 is configured to receive a pusher 132 (described below) or other product biasing mechanism that may be provided to urge products towards the front of merchandising system 10. In a preferred embodiment where channel 28 is included in merchandising system 10, at least one rib 38 may be provided on the top surface of each flange 36. Each rib 38 extends the length of flange 36 and provides a surface on which the products that are placed in merchandising system 10 will rest or slide when they are moved along the length of center track 20. Ribs 38 help facilitate the movement of products along center track 20 by reducing the amount of friction between the products and center track 20. It is important to note, however, that merchandising system 10 may be used with any type of panel, divider sections, or partitions, such as in a shelf divider that does not employ a pusher. Thus, in alternative embodiments, the channel may be omitted.

As shown in FIG. 4, an "L" divider channel (e.g., end channel, panel, track, side member, shelf divider, etc.) shown as end track 60 may be provided for use with merchandising system 10. End track 60 may have a horizontal section or portion 62 and a vertical section or portion 64. Portions 62 and 64 form an "L" shaped cross-section. A top side 67 of horizontal portion 62 may be provided with protrusions or ribs 66. Like ribs 38, ribs 66 provide friction reduction on horizontal portion 62 (which would otherwise be the product support surface) such that products may be urged or pushed more easily along horizontal portion 62. Additionally, end track 60 may be provided with ribs shown as protrusions 68 on a bottom side 69 of horizontal portion 62. Protrusions 68 may increase the stiffness, strength, and rigidity of end track 60, or alternatively, may be configured to support horizontal portion 62 above a surface such as a shelf or any other similar surface. In alternative embodiments, all protrusions 68 may be the same size and have the same orientation, protrusion angle, and extension direction, or they may differ in these respects. For example, some protrusions (shown as protrusions 68*a*) may be used to support end track 60, and as a result may be longer or otherwise different than other protrusions (shown as protrusions 68) that may be used for structural support, strength, stiffness, and rigidity. Supporting protrusions may also have a different orientation, protrusion angle, and extension direction than the strengthening protrusions.

Additionally, end track 60 is provided with an interface or engagement portion 70 that is configured to engage, couple, or interface with center track 20. In an exemplary embodiment, engagement portion 70 is a U-shaped engagement section provided on an end 72 of horizontal portion 62 that is sized and configured to engage one of interfaces 26 on center track 20. The engagement portion 72 is designed so that it can fit over an interface 26, with the interface 26 entering the opening in the U-shaped engagement portion 72. In alternative embodiments, the engagement portion may freely slide over the interface or may lock onto, or clip over the interface. In one exemplary embodiment, engagement portion 70 may extend the entire length of end track 60. However, in other alternative embodiments, the engagement portion may extend intermittently along the length of the end track, or may extend for only a part of the length of the end track.

As shown in FIGS. 3 and 4, a "T" divider track (e.g., panel, track, separating panel, separating channel, side member, shelf divider, etc.) shown as divider track 90 may be provided for use with merchandising system 10. Divider track 90 may have a horizontal section or portion 92 and a vertical section or portion 94 that form a substantially "T" shaped cross-section. A top side 97 of the horizontal portion 92 may be provided with ribs or protrusions 96. Ribs 96 may provide friction reduction on horizontal portion 92 (which is the product support surface) such that products may be urged or pushed more easily along horizontal portion 92. Additionally, divider track 90 may be provided with ribs shown as protrusions 98 on a bottom side 99. Protrusions 98 may increase the stiffness, strength, and rigidity of divider track 90, or alternatively, may be configured to support horizontal portion 92 on a surface such as a shelf, or other similar surface. In alternative embodiments, all protrusions may be the same size and have the same orientation, protrusion angle, and extension direction, or they may differ in these respects. For example, some protrusions may be used to support the divider track, and as a result may be longer or otherwise different than other protrusions that may be used for structural support, strength, stiffness, and rigidity. Supporting protrusions may also have a different orientation, protrusion angle, and extension direction than the strengthening protrusions.

Additionally as shown in FIG. 4, divider track 90 is provided with at least one engagement portion 100 that is substantially identical to engagement portion 70 provided on end track 60. In an exemplary embodiment, an engagement portion 100 is provided on each end 102 of horizontal portion 92. However, in other embodiments, engagement portions may be placed at various locations on the divider track.

In alternative embodiments, either or both of the end track and the divider track may include a channel similar to channel 28 that is configured to receive or accommodate a pusher or other product biasing mechanism. In such embodiments, the channel may be provided on the horizontal portions or on the vertical portions of the end track and the divider track, respectively. Additionally, channels may be provided on more than one of tracks.

Figure 2:
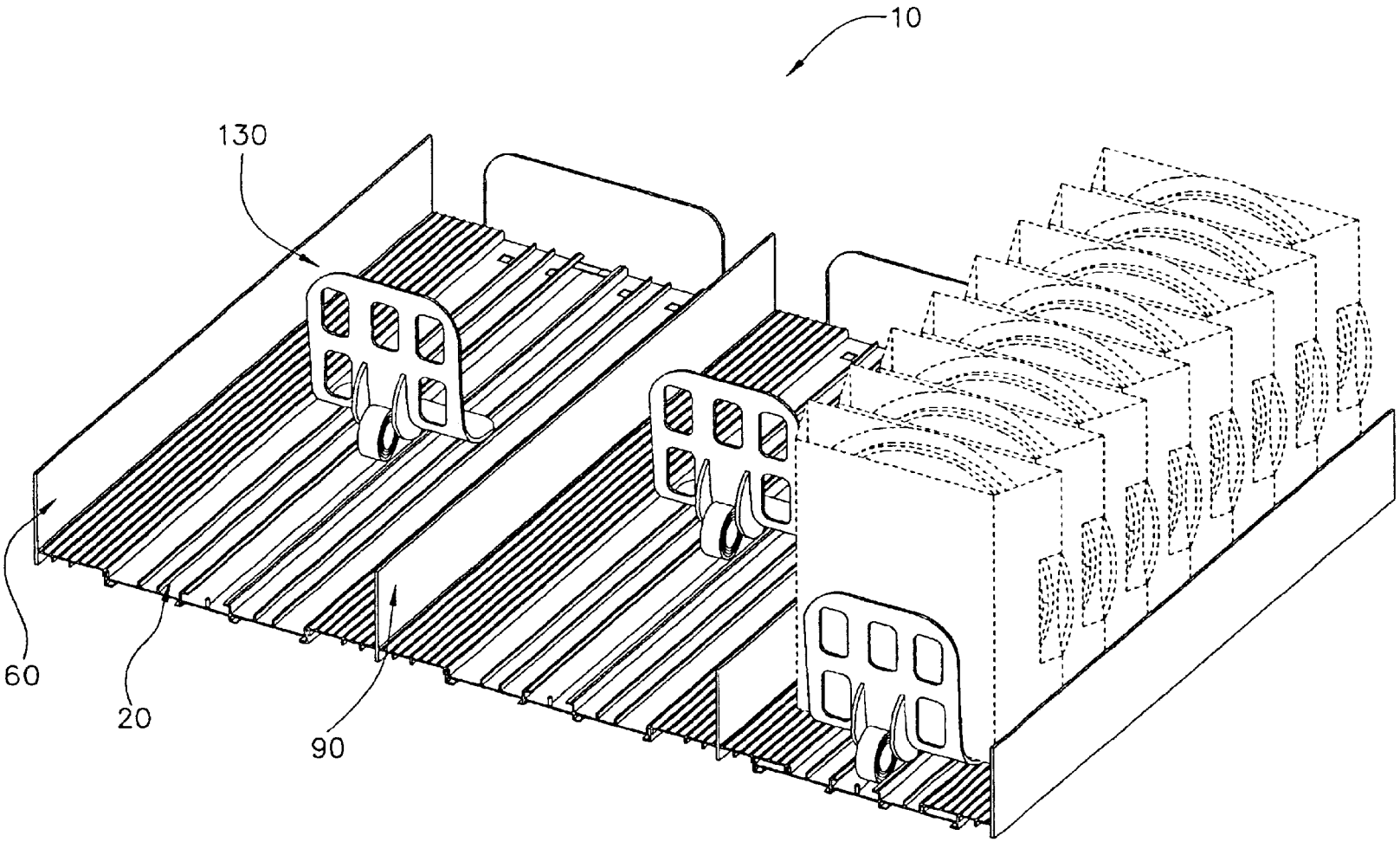
FIG. 2 is a rear perspective view of a merchandising system according to an exemplary embodiment.

As shown in FIGS. 2 and 3, a pusher assembly 130 may be provided for use with the merchandising system 10. It should be noted that the pusher assembly may be omitted from merchandising system 10. In an exemplary embodiment pusher assembly 130 includes a paddle or pusher 132 and a biasing apparatus or mechanism 134.

As shown in FIGS. 2 to 4, pusher 132 may comprise a plate 136, flanges 138, and panels 140. Plate 136 may be a curved panel as shown in FIG. 3 or may be a substantially flat panel that extends perpendicularly away from the track to which pusher assembly 130 is coupled. Plate 136 includes a front face or surface 137 that comes into contact with products as the pusher assembly moves towards the front of the shelf. Panels 140 may be spaced apart and parallel to each other. Flanges, T-shaped members, guides, tracks, or rails shown as but not limited to flanges 138 may be attached to plate 136 and are configured to fit in channel 28 provided in center track 20, or in a channel that may be provided in divider track 90 and/or end track 60. Indicia may be provided on front surface 137.

Biasing mechanism 134 (which may be a spring such as a coil spring) may be provided to bias or push pusher 132 toward the front of merchandising system 10. In the preferred embodiment, biasing mechanism 134 is a coil spring 135 that is coupled to the front of center track 20. Coil spring 135 may be connected to center track 20 by a hook at the end of coil spring 135 that fits around the front of center track 20, or through the use of fasteners such as screws, rivets, bolts, snaps, hold downs, clips, clamps or other various connectors or connection methods. The coiled portion of coil spring 135 may be contained within a cavity 146 on back side 142 of pusher 132 such that when pusher 132 is retracted (i.e. pulled toward the back of merchandising system 10) coil spring 135 will bias pusher 132 in a forwardly direction.

In an exemplary embodiment of the present invention shown in FIG. 3, a front wall (e.g., a front lens, wall, retainer, plate, etc.) shown as front plate 160 may be provided for use with merchandising system 10. Front plate 160 may be provided with clips 162 configured to couple front pate 160 to the front of center track 20. Clips 162 retain front plate 160 in place, and allow front plate 160 to retain products that are forced against it by the biasing force of pusher assembly 130. Front plate 160 also may be provided with "fingers" or tabs 164 that fit on opposite sides of horizontal portion 22 of center track 20 to help couple or hold front plate 160 in place. In a preferred embodiment, front plate 160 is constructed from a transparent material, which allows a consumer or user of merchandising system 10 to see the articles provided in merchandising system 10. Alternatively, front plate 160 may be constructed from a variety of colors and be of varying degrees of opacity. In other embodiments, front plate 160 may be configured to couple to either or both of end track 60 and divided track 90.

According to various exemplary embodiments, center track 20, end track 60, and divider track 90 may generally be made from extruded plastic or other plastics. However, the tracks may be made from a variety of materials that provide sufficient support for displayed products, which may include steel, steel alloys, aluminum, other metal alloys, plastics, polymers, composites, etc. The use of plastic offers several advantages including that the pieces are moldable in a variety of different colors, surface finishes, textures, etc.

According to various exemplary embodiments, pusher 132 and front plate 160 may be constructed from a wide variety of different materials including steel, steel alloys, aluminum, other metal alloys, plastics, injection molded plastic, polymers, composites, etc.

According to an exemplary embodiment, merchandising system 10 is intended to provide selectively adjustable shelf dividers or shelf sections from different combinations of center tracks 20, end tracks 60, and divider tracks 90. Merchandising system 10 will receive products or merchandise and may include a product urging system of a type having a channel 28 and a pusher 132 guided in channel 28.

To load products into a particular section or division of merchandising system 10, a pusher 132 that may be included in that section is pushed toward the back of the shelf. Products are then placed on the tracks between pusher 132 and front plate 160. Pusher 132 will be put in a position that is the farthest back from the front of the shelf when the section of merchandising system 10 in which pusher 132 is included is fully stocked with products. As products are removed from that section of merchandising system 10, pusher 132, which is urged forward by coil spring 135, will push the products remaining in that section toward the front of the shelf. Examples of the type of shelf dividers that merchandising system 10 may utilize are described in U.S. patent application Ser. No. 09/815,569, entitled SHELF TRAY SYSTEM, filed Mar. 23, 2001, which is incorporated herein by reference. It should be noted, however, that the product urging system is not required for use in alternative embodiments, which may be used in conjunction with other shelving divider arrangements (such as basic wall dividers).

The arrangement of center tracks 20, end tracks 60, and divider tracks 90 can be reconfigured and resized to create a merchandising system 10 that conveniently allows for the display of different sized products. To provide this reconfiguration capability, tracks 20, 60, and 90 may be configured to selectively engage with each other and to allow for the interconnection of a plurality of tracks 20, 60, and 90.

Merchandising system 10 may be placed on top of existing shelves or shelving units. It may simply rest on the top of the shelf and be supported by feet, shown as protrusions 68 and 98 of end track 60 and divider track 90, respectively, and protrusions 24 of center track 20. Alternatively, low-bond adhesives may be applied to restrict the motion of merchandising system 10.

The configurations of tracks 20, 60 and 90 allow a user to pick and choose which tracks will be used in constructing merchandising system 10, and thereby allow a user to construct merchandising system 10 in a wide variety of configurations. For example, one configuration of merchandising system 10 may require two end tracks 60, two center tracks 20, and one divider track 90. Another configuration may require two end tracks 60, five center tracks 20, and four divider tracks 90. Because merchandising system 10 may be assembled and constructed with a wide variety of configurations of tracks 20, 60, and 90, it may effectively operate in the presence of a wide variety of environmental limitations such as space constraints, product size constraints, and so on.

According to an exemplary embodiment, center tracks 20 interconnect end tracks 60 and/or divider tracks 90 to form merchandising system 10. End track 60 and/or divider track 90 each include an engagement portion 70 and 100, respectively (which may take the form of clips, connectors, or various other couplers), each of which attaches to an interface 26 on center track 20. To change the spacing between the tracks (and thus the size of the product channel created by the interconnection of tracks 20, 60, and 90), either or both of engagement portions 70 and 90 of end track 60 and/or divider track 90, respectively, may be disconnected from the interface 26 to which it is attached, and then reattached, recoupled, reconnected, or rejoined with another interface 26 that is located a different distance from the longitudinal axis of center track 20. Merchandising system 10 thereby allows selected tracks 20, 60, and/or 90 to be adjusted, resized, refaced and/or reconfigured without requiring the adjustment of neighboring or adjacent tracks 20, 60, and 90.

According to a particularly preferred embodiment, four interfaces 26 (e.g., a set of interfaces) are provided on each side of the longitudinal axis of center track 20. The four interfaces 26 are spaced to allow for at least four different track spacings, allowing merchandising system 10 to be used for products of at least four different sizes. According to other exemplary embodiments, more or less interfaces 26 may be provided on center track 20 at various locations. This feature of tracks 20, 60, and 90 allows merchandising system 10 to be customized to specific products, manufacturers, or set of products. Accordingly, depending on the number and locations of interfaces 26, merchandising system 10 may be configured for use with only one product, a specific set of products, or a wide variety of products. For example, in one configuration merchandising system 10 may have a first spacing that accommodates a first product size, a second spacing that accommodates a second product size, and so on. Center track 20 may be specially manufactured to accommodate a specific product or set of products, in which case, only a certain number of interfaces 26 will be specially placed at locations that will allow merchandising system 10 to operate with that specific product or these specific products. In another alternative embodiment, center track 20 may be manufactured to accommodate a wide variety of products, in which case, a relatively large number of interfaces 26 may be evenly distributed on the horizontal surface of center track 20 to allow for a larger variety of spacing options.

The center pusher configuration of center track 20 shown in the FIGURES advantageously provides merchandising system 10 with the ability to accommodate a larger variety of product sizes, as compared to a side pusher configuration that may be incorporated into end track 60 and/or divider track 90. A center pusher, shown as but not limited to pusher 132, will more evenly push on the product by pushing on the center of the product. The product is less likely to twist, turn, "fish-tail," or be subject to an off-center force that could rotate the product. A larger product is more susceptible to this off-center force. Advantageously, a center pusher configuration will not cause larger sized products to rotate. It should be noted, however, that side pusher configurations may still be used in merchandising system 10.

Tracks 20, 60, and 90 and the method of connecting them shown in the FIGURES provide certain advantages. One such advantage is that the design of tracks 20, 60, and 90 allows for simple and convenient construction. Tracks 20, 60, and 90 may be constructed using simple extrusion methods, as opposed to a more costly injection molding process. Thus, the components of merchandising system 10 are easier and less expensive to construct, require less time to produce, require less complicated tools for manufacture, and require fewer parts.

It is also important to note that the construction and arrangement of the elements of merchandising system 10 as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter of the present inventions. For example, elements shown as integrally formed may be constructed of multiple parts or elements show as multiple parts may be integrally formed; the operation of the interfaces of the center track and the engagement portions of the end tracks and the divider tracks, respectively, may be reversed or otherwise varied (see FIG. 5); the length or width of the tracks or other elements of merchandising system, such as protrusions and ribs, may be varied (see FIG. 6); and the nature or number of discrete adjustment positions provided between tracks 20, 60, and 90 may be varied (for example, by variations in the number of engagement points, size of the engagement points, or type of engagement). It should be noted that the elements and/or assemblies of merchandising system 10 may be constructed from any of a wide variety of materials that provide sufficient strength or durability, including any of a wide variety of moldable plastic materials (such as high-impact plastic), in any of a wide variety of colors, textures and combinations. It should also be noted that merchandising system 10 may be used in association with a shelf (e.g. of a shelving unit or the like) or any of a wide variety of other surfaces in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A merchandising system for at least one set of articles including a first set of articles having a first size and a second set of articles having a second size smaller than the first size comprising:

a base;

a first divider coupled to the base; and a second divider coupled to the base;

wherein a compartment of a first size is provided when the first divider is coupled to a first portion of the base and the second divider is coupled to a third portion of the base;

wherein a compartment of a second size is provided when the first divider is coupled to a second portion of the base and the second divider is coupled to the third portion of the base; and wherein the compartment is configured to be initially provided in the first size so that the first divider is coupled to a first portion of the base and the second divider is coupled to a third portion of the base;

provided in the second size after being provided in the first size so that the first divider is coupled to a second portion of the base and the second divider is coupled to the third portion of the base: and returned to the first size after being provided in the second size so that the first divider is coupled to the first portion of the base and the second divider is coupled to the third portion of the base;

so that the compartment is configured to be provided in the first size for the first set of articles and the compartment is configured to be provided in the second size for the second set of articles.

2. The merchandising system of claim 1 wherein the compartment of the first size is formed by coupling the first divider to the base with a first interface and the second divider to the base with a third interface.

3. The merchandising system of claim 2 wherein the first interface comprises a portion of the first divider and the third interface comprises a portion of the second divider.

4. The merchandising system of claim 2 wherein the first interface comprises a portion of the base and the third interface comprises a portion of the base.

5. The merchandising system of claim 2 wherein the compartment of the first size comprises a width defined by a distance between the first divider and the second divider.

6. The merchandising system of claim 1 wherein the first divider comprises a generally vertical wall and the second divider comprises a generally vertical wall, and wherein the first divider has a generally horizontal portion for coupling to the base.

7. The merchandising system of claim 1 wherein the first divider is integrally formed and the base is integrally formed and the first divider and the base are configured to directly couple together.

8. The merchandising system of claim 1 wherein the base further comprises a generally horizontal surface.

9. The merchandising system of claim 8 wherein the horizontal surface further comprises ribs.

10. The merchandising system of claim 1 wherein the base is directly coupled to the first divider.

11. The merchandising system of claim 1 wherein the base further comprises a slot.

12. The merchandising system of claim 11 further comprising a pusher assembly configured to be received in the slot.

13. The merchandising system of claim 1 wherein the base is coupled to the first divider by engagement of a protrusion.

14. The merchandising system of claim 13 wherein the protrusion of the base engages with a channel of the divider.

15. The merchandising system of claim 13 wherein the protrusion of the divider engages with a channel of the base.

16. The merchandising system of claim 1 wherein the first divider and the second divider are separated by a first distance when the first divider is coupled to the first portion of the base and the second divider is coupled to the second portion of the base and wherein the first divider and the second divider are separated by a second distance when the first divider is coupled to the third portion of the base and the second divider is coupled to the second portion of the base.

17. A merchandising system for at least one set of articles including a first set of articles having a first size and a second set of articles having a second size smaller than the first size comprising:

a first member having a first connector;

a second member having a second connector; and a third member having a first set of portions comprising a first portion and a second portion and a second set of portions comprising a third portion and a fourth portion;

wherein the first connector releasably couples to one of the first portion and the second portion of the first set of portions and wherein the second connector releasably couples to one of the third portion and the fourth portion of the second set of portions; and wherein a compartment of a first size is provided when the first connector of the first member is coupled to the first portion of the third member and the second connector of the second member is coupled to the second portion of the third member;

wherein a compartment of a second size is provided when the first connector of the first member is coupled to the second portion of the third member and the second connector of the second member is coupled to the third portion of the third member; and wherein the compartment is configured to be initially provided in the first size so that the first connector of the first member is coupled to the first portion of the first set of portions and the second connector of the second member is coupled to the third portion of the second set of portions:

provided in the second size after being provided in the first size so that the first divider is coupled to a second portion of the base and the second divider is coupled to the third portion of the base; and returned to the first size after being provided in the second size so that the first divider is coupled to the first portion of the base and the second divider is coupled to the third portion of the base;

so that the compartment is configured to be provided in the first size for the first set of articles and the compartment is configured to be provided in the second size for the second set of articles.

18. The merchandising system of claim 17 wherein the first member comprises a first divider and the second member comprises a second divider.

19. The merchandising system of claim 18 wherein the compartment of the first size is formed by coupling the first divider to the third member with a first interface and the second divider to the third member with a second interface.

20. The merchandising system of claim 18 wherein the first divider comprises a generally vertical wall and the second divider comprises a generally vertical wall, and wherein the first divider has a generally horizontal portion for coupling to the third member.

21. The merchandising system of claim 17 wherein the first set of portions comprise at least two protrusions.

22. The merchandising system of claim 17 wherein the first member comprises a track, the second member comprises a track, and the third member comprises a track.

23. The merchandising system of claim 17, further comprising a pusher assembly provided on the third member.

24. The merchandising system of claim 17 wherein the third member comprises a generally horizontal base.

25. The merchandising system of claim 17 wherein the first member is integrally formed and the third member is integrally formed and the first member and the third member are configured to directly couple together.

26. A merchandising system for at least one set of articles including a first set of articles having a first size and a second set of articles having a second size smaller than the first size comprising:

a first track comprising a horizontal surface having a first set of protrusions comprising a first protrusion and a second protrusion extending from the horizontal surface and a second set of protrusions comprising a third protrusion and a fourth protrusion extending from the horizontal surface;

a second track comprising a vertical panel and a horizontal surface having a first portion;

a third track comprising a generally vertical panel and a generally horizontal surface having a second portion;

wherein the first portion releasably couples to the first protrusion and the second protrusion of the first set of protrusions and the second portion releasably couples to the third protrusion and the fourth protrusion of the second set of protrusions;

wherein a compartment of a first size is provided when the first portion of the second track is coupled to the first protrusion and the second portion of the third track is coupled to the third protrusion;

wherein a compartment of a second size is provided when the first portion of the second track is coupled to the second protrusion and the second portion of the third track is coupled to the third protrusion;

so that the compartment can be provided in the first size for the first set of articles and the compartment can be provided in the second size for the second set of articles;

wherein the compartment can be returned to the first size after being provided in the second size.

27. The merchandising system of claim 26, wherein the compartment of the first size is formed by coupling the second track to the first track with a first interface and the third track to the first track with a second interface.

28. The merchandising system of claim 26 wherein the first track is integrally formed and the second track is integrally formed and the first track and the second track are configured to directly couple together.

29. The merchandising system of claim 26 further comprising a pusher slidable along the first track and a biasing means urging the pusher towards the front of the first track.

30. The merchandising system of claim 30 wherein the pusher is slidable along a channel formed in the first track.

31. The merchandising system of claim 30 wherein the pusher comprises a pusher plate.

32. The merchandising system of claim 31 wherein the pusher plate comprises a curved panel.

33. The merchandising system of claim 30 wherein the channel comprises a slot.

34. The merchandising system of claim 29 wherein the biasing means comprises a spring.

35. The merchandising system of claim 34 wherein the spring comprises a coil spring.

36. The merchandising system of claim 26 wherein the protrusions are integrally formed with the first track.

37. The merchandising system of claim 26 wherein the portions of the second and third tracks comprise openings.

38. The merchandising system of claim 37 wherein the protrusions fit into the openings of the portions.

39. The merchandising system of claim 26 wherein the tracks comprise a plastic material.

40. The merchandising system of claim 39 wherein the plastic material is an extruded plastic.

41. The merchandising system of claim 26 wherein the first track comprises a generally flat member.

42. The merchandising system of claim 26 further comprising a front plate coupled to at least one of the tracks.

43. The merchandising system of claim 26 wherein the tracks further comprise a product support surface.

44. The merchandising system of claim 43 wherein the product support surface comprises one or more friction reducing ribs.

45. The merchandising system of claim 26 wherein the portions of the second and third tracks are integrally formed with the second and third tracks.

* * * * *

UNITED STATES PATENT AND TRADEMARK OFFICE

CERTIFICATE OF CORRECTION

PATENT NO. : 6,886,699 B2
DATED : May 3, 2005
INVENTOR(S) : Allen E. Johnson et al.

It is certified that error appears in the above-identified patent and that said Letters Patent is hereby corrected as shown below:

Column 12,
Line 24, delete “30” and insert therefor -- 29 --.

Signed and Sealed this

Eleventh Day of October, 2005

JON W. DUDAS
*Director of the United States Patent and Trademark Office*